US005442924A

United States Patent [19]

Tsai et al.

[11] Patent Number: 5,442,924

[45] Date of Patent: Aug. 22, 1995

[54] LIQUID REMOVAL FROM NATURAL GAS

[75] Inventors: Tom C. Tsai, Houston; Fred W. Kanter, Brazoria; George M. King, Lake Jackson, all of Tex.

[73] Assignee: The Dow Chemical Company, Midland, Mich.

[21] Appl. No.: 197,038

[22] Filed: Feb. 16, 1994

[51] Int. Cl.[6] ..... F25J 3/08

[52] U.S. Cl. ..... 62/15; 62/37

[58] Field of Search ..... 62/14, 15, 37

[56] References Cited

U.S. PATENT DOCUMENTS

| | | | |
|---|---|---|---|
| 2,557,171 | 6/1951 | Bodle et al. | 62/23 |
| 2,650,481 | 9/1953 | Cooper et al. | 62/175.5 |
| 2,713,780 | 7/1955 | Williams | 62/175.5 |
| 2,713,781 | 7/1955 | Williams | 62/39 |
| 2,813,010 | 11/1957 | Hutchins | 62/37 |
| 2,823,523 | 2/1958 | Eakin et al. | 62/31 |
| 2,880,592 | 4/1959 | Davison et al. | 62/25 |
| 2,933,900 | 4/1960 | Hanthorn | 62/21 |
| 2,968,160 | 1/1961 | Schilling et al. | 62/14 |
| 3,100,147 | 8/1963 | Hull | 62/37 |
| 3,132,016 | 5/1964 | Kurata | 62/15 |
| 3,282,062 | 11/1966 | Hudson et al. | 62/39 |
| 3,292,380 | 12/1966 | Bucklin | 62/38 |
| 3,354,663 | 11/1967 | Hendrix | 62/12 |
| 3,373,574 | 3/1968 | Fisher | 62/23 |
| 3,397,138 | 8/1968 | Bacon | 208/340 |
| 3,595,782 | 7/1971 | Bucklin et al. | 62/23 |
| 3,625,016 | 12/1971 | Hoffman | 62/26 |
| 3,656,312 | 4/1972 | Streich | 62/28 |
| 3,675,435 | 7/1972 | Jackson et al. | 62/26 |
| 3,702,541 | 11/1972 | Randall et al. | 62/26 |
| 3,724,226 | 4/1973 | Pachaly | 62/39 |
| 3,791,157 | 2/1974 | Tracy et al. | 62/15 |
| 3,837,172 | 9/1974 | Markbreiter et al. | 62/24 |
| 4,040,806 | 8/1977 | Kennedy | 62/28 |
| 4,061,481 | 12/1977 | Campbell et al. | 62/29 |
| 4,140,504 | 2/1979 | Campbell et al. | 62/28 |
| 4,157,904 | 6/1979 | Campbell et al. | 62/27 |
| 4,171,964 | 10/1979 | Campbell et al. | 62/24 |
| 4,185,978 | 1/1980 | McGalliard et al. | 62/28 |
| 4,203,741 | 5/1980 | Bellinger et al. | 62/24 |
| 4,251,249 | 2/1981 | Gulsby | 62/28 |
| 4,257,794 | 3/1981 | Shirokov et al. | 62/28 |
| 4,278,457 | 7/1981 | Campbell et al. | 62/24 |
| 4,285,708 | 8/1981 | Politte et al. | 62/28 |
| 4,337,071 | 6/1982 | Yang | 62/14 |
| 4,453,956 | 6/1984 | Fabbri et al. | 62/18 |
| 4,556,404 | 12/1985 | Shenoy et al. | 62/17 |
| 4,579,565 | 4/1986 | Heath | 55/20 |
| 4,629,484 | 12/1986 | Kister | 62/29 |
| 4,666,483 | 5/1987 | Gauthier | 62/24 |
| 4,695,303 | 9/1987 | Montgomer, IV et al. | 62/24 |
| 4,698,081 | 10/1987 | Aghili | 62/24 |
| 4,854,955 | 8/1989 | Campbell et al. | 62/24 |
| 4,869,740 | 9/1989 | Campbell et al. | 62/24 |
| 4,889,545 | 12/1989 | Campbell et al. | 62/24 |
| 5,026,408 | 6/1991 | Saunders et al. | 62/24 |
| 5,035,732 | 7/1991 | McCue, Jr. | 62/24 |
| 5,144,451 | 5/1992 | Rambo et al. | 62/24 |
| 5,199,266 | 4/1993 | Johansen | 62/8 |

*Primary Examiner*—Ronald C. Capossela

[57] ABSTRACT

Methods have been developed for removing valuable liquid condensates from natural gas streams, which in certain embodiments do not use pumps and which are operated by the input pressure of gas to be processed. In other methods according to this invention pumps and equipment with moving parts are used. In one aspect a method described here includes: cooling input gas to a desired level to form a mist in the gas of condensed droplets of desired size, e.g., but not limited to, droplets of a largest dimension of at least 0.1 micrometer, 0.7 micrometer, or less than 1.0 micrometer; based on an analysis of the condensates, selecting a desired microfilter media to filter liquid condensates from the cooled gas; and filtering the cooled gas producing a liquid condensate(s) stream and a gas stream, each of which may be usable as fuel or in other methods or apparatuses. A gas collector has been developed to collect all or substantially all of the condensates from a gas sample, e.g. condensed hydrocarbons in a natural gas stream, for precise analysis and aid in filter media selection. A method and apparatus have been developed for analyzing a particular microporous filter media's filtration of condensates from a particular gas stream which employs collection of a liquids sample from inlet gas, from liquids produced by filtration, and from an outlet gas stream; the collected liquids are then analyzed and a suitable media is selected based on the analysis.

29 Claims, 4 Drawing Sheets

LIQUID REMOVAL FROM NATURAL GAS

BACKGROUND OF THE INVENTION

1. Field of the Invention

This invention is directed to the removal of liquid from gas; and, in one aspect, to the removal of and recovery of liquid condensates from a natural gas stream.

2. Description of Related Art

The related art discloses a broad variety of systems and methods for removing liquids from gas and for removing liquids with fuel value from natural gas. Many of these processes are very sophisticated and complex, and require the use of a multiplicity of expensive equipment such as towers and rectifiers. The following U.S. patents are representative of such related art: U.S. Pat. Nos. 3,595,782; 2,557,171; 2,968,160; 2,933,900; 2,650,481; 4,061,481; 4,040,806; 3,354,663; 3,282,062; 3,837,172; 2,713,780; 5,035,732; 4,629,484; 4,666,483; 4,695,303; 4,453,956; 2,823,523; 5,026,408; 4,251,249; 5,199,266; 4,257,794; 3,702,541; 4,579,565; 4,171,964; 4,157,904; 5,114,451; 4,278,457; 4,285,708; 4,889,545; 4,854,955; 3,373,574; 4,185,978; 4,869,740; 3,656,312; 3,292,380; 2,880,592; 3,675,435; 3,397,138; 4,140,504; 3,724,226; 3,625,016; 4,556,404; 4,698,081; 2,713,781; 4,203,741.

Certain conventional prior art vane-type gas/liquid separators with separator elements or other mechanical separating apparatus can remove liquid droplets greater than one micrometer in size from a mist stream.

SUMMARY OF THE PRESENT INVENTION

The present invention, in one embodiment, discloses a system and method for removing liquids, particularly liquids with fuel value, from a natural gas stream. The method includes introducing the natural gas feed stream (e.g. typical natural gas as supplied from a pipeline) to a throttling valve which lowers the pressure of the initial feed stream and also lowers its temperature. The initial stream may have liquids in it and the throttling step produces more condensables (liquids), e.g. in the form of a mist of droplets in the stream of gas which are suitable for microfiltration. The throttled stream is then fed to a microfiber gas/liquid filter wherein filtered liquid flows from the bottom of the filter and filtered gas flows from the top of the filter. Both the filtered liquid and the filtered gas may be used in other methods or processes.

In another embodiment a heat exchange step is used prior to the throttling step to either produce more condensables and/or to effect the condensation of certain stream components, e.g. particular hydrocarbons. In one aspect, cooled gas from the filter may be used in the heat exchanger to cool the incoming natural gas.

In another embodiment, when a combination of multiple input natural gas streams are to be processed and one of them is at a relatively high pressure, the high pressure stream (or streams) is fed to a first filter producing a usable gas stream and a usable liquids (condensables) stream. The usable gas stream is fed to a device such as a turboexpander which recovers or uses the stream's energy to drive a compressor or alternator, and at the same time the gas pressure is reduced and temperature is lowered and is then fed, with other incoming natural gas stream(s) to a second filter, producing another usable gas stream and another usable condensates stream. In one aspect such a method is enlarged to provide for multiple filtration steps with multiple uses of usable gas streams, particularly when there are multiple input natural gas streams with different input pressures and/or when increased liquids recovery is desired.

Certain embodiments of methods as discussed above are preferably conducted with the temperature of the stream fed to a filter apparatus of about −110° to about +70 degrees F. and preferably not lower than −95 degrees F. (and most preferably between −60 degrees F. and +32 degrees F.); and preferably at pressures between about 0 to about 1200 p.s.i.g.

To enhance the methods described above, in one embodiment according to the present invention an accurate analysis is made of the natural gas to be processed to determine the stream composition, distribution of condensables, and to accurately predict the physical properties of the stream. This analysis provides information for the selection of suitable filter media; e.g. Uniform (TM) microfiber filter media as commercially available from Porous Media Corporation of St. Paul. Such media removes, e.g. all droplets 0.7 micrometer and larger; 0.6 micrometer and larger; or 0.5, 0.4, 0.3, 0.2, or 0.1 micrometer and larger. Apparatus for conducting such an analysis according to the present invention includes a probe for disposition in the gas stream for taking a gas sample and sending it through a probe line to a condensing coil disposed in a cold trap, e.g. a container with ice or dry ice therein. Condensed liquid from the gas sample flows into a collection cylinder. The sample stream then flows through a valve or valves for further condensation of liquid and additional condensables flow into a second collection cylinder. The collected liquid(s) are then analyzed, e.g. by a gas chromatograph. A specific filter media is tested, according to the present invention, by feeding a gas stream of known composition through a known filter media. An inlet cold trap collects liquids in the inlet stream and an outlet cold trap collects liquids in an outlet gas stream. Liquids drained from the filter media are also collected. An analysis of the various collected liquids indicates what liquids (e.g. what type of hydrocarbons and what molecular weight hydrocarbons) are filtered by this particular media for a stream under these particular conditions (temperature, pressure) with this particular input. With this knowledge and with the knowledge gained from tests of a variety of filter media, when an inlet natural gas stream of known composition is to be processed and an exit stream of a particular dryness or Btu content is desired, a suitable filter media is chosen based on known filter media efficiency and output for such a stream. Thus an exit stream from systems according to this invention may be produced of a desired composition, dryness, or Btu content.

It is, therefore, an object of at least certain preferred embodiments of the present invention to provide:

New, useful, unique, efficient, nonobvious methods for removing condensable liquids from a natural gas stream;

Such methods which do not operate at cryogenic temperature;

Such methods which do not require complex, expensive equipment, especially expensive refrigeration equipment;

Such methods which operate above −95 degrees F.;

Such methods which include detailed accurate analysis of an initial natural gas feed stream so that appropriate method steps and filter(s) may be used;

Such methods which are operated by the pressure of inlet gas and which, in one aspect require no pumps and which are operated by the pressure of input gas;

Such methods and apparatus for removing condensed hydrocarbon droplets of a largest dimension of one-tenth micrometer or larger from a gas and mist stream in which they have been condensed;

Such methods which process a plurality of different input natural gas streams; and Gas collection apparatus for removing substantially all condensates from a gas sample.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
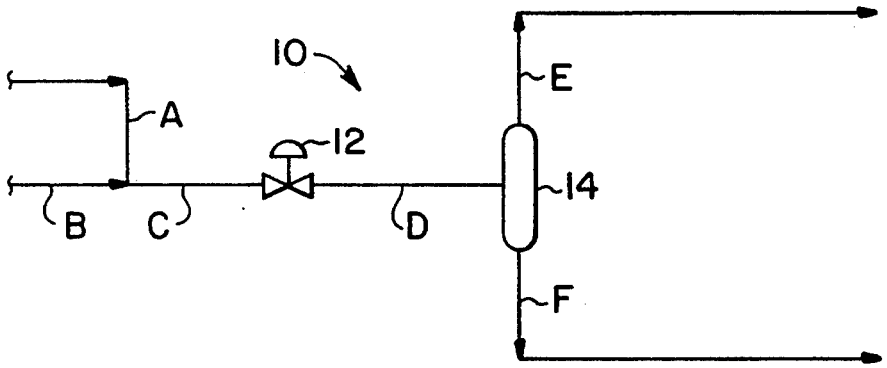
FIG. 1 is a schematic view of a method according to the present invention.

Referring now to FIG. 1, natural gas under pressure from two typical pipeline sources A and B (whose compositions are shown in Table 1) flows in flow lines with those designations to form a combined stream C which is introduced to a J-T valve 12. The gas in line A in one embodiment is, e.g. at 61.8 degrees F.; 743.4 psig; and 75 MMSCFD (MMSCFD means "million standard cubic feet per day"). The gas in line B in one embodiment is, e.g. at 62.7 degrees F.; 615.2 psig; and 100 MMSCFD. The gas in combined stream C is, in this one embodiment, at 58.2 degrees F. and 615.2 psig. In certain most preferred embodiments the pressure alone of the inlet natural gas stream or streams provides the driving energy for the method and no external additional energy is required to accomplish the method. The J-T valve is used to expand the gas, reducing the pressure to 300 psig and cooling the gas to about 36.8 degrees F. Preferably the temperature is reduced so that a thick mist of droplets of hydrocarbon liquids is formed in the throttled gas stream D with the droplets preferably with a largest dimension of 0.1 micrometer or greater. The throttled stream D is fed to a filter separator 14 containing microporous filter media which, in this embodiment, filters out droplets 0.1 micrometer or larger in a largest dimension. A gas stream E is produced which flows from the top of the filter separator; and a liquid stream F is produced which flows from the bottom of the filter separator 14. In the particular embodiment discussed for input streams A and B, the gas stream E is at 36.8 degrees F. and 300 psig; and the liquid stream F is at 36.8 degrees F. and 300 psig. The composition of the streams is as shown in Table 1. The line D can be sampled and the sample analyzed to indicate stream composition, including types of condensables.

Figure 2:
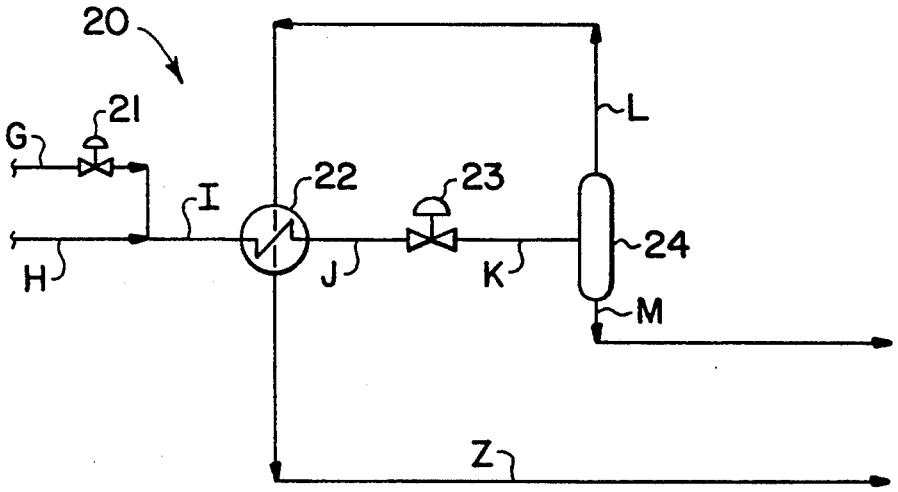
FIG. 2 is a schematic view of a method according to the present invention.

Referring now to FIG. 2, a method 20 is illustrated in which a combined gas stream may be cooled by heat exchange in addition to cooling by action of a throttling valve. This may be desirable if additional cooling is needed to condense out certain stream components and/or if it is desired to remove more liquid from a stream. Input gas in lines G and H is combined to form the gas stream in line I which is passed through a heat exchanger 22. Cooled stream J is then acted on by a J-T valve 23, producing the stream in line K. The stream in line K is fed to a filter separator 24 with suitable microporous filter media, producing a gas stream in line L and a liquid stream in line M. The gas stream in line L, which is cooler than gas in the stream of line I, is cycled through the heat exchanger to cool the gas in line I, producing a warmed stream in flow line Z. In one embodiment the gas streams have these characteristics:

| | Temperature (degrees F.) | Pressure (psig) | Volume (MMSCFD) |
|---|---|---|---|
| G | 61.8 | 743.4 | 75 |
| H | 62.7 | 615.2 | 100 |
| I | 58.2 | 615.2 | |
| J | −6.8 | 615.2 | |
| K | −34.4 | 300 | |
| L | −34.4 | 300 | |
| M | −34.4 | 300 | |

-continued

| | Temperature (degrees F.) | Pressure (psig) | Volume (MMSCFD) |
|---|---|---|---|
| Z | 42.2 | 300 | |

The composition of the streams G–Z is as shown in Table 2.

Certain embodiments of the methods of FIGS. 1 and 2 preferably employ no pumps or other energy-using devices and are driven solely by the pressure of the input gas. In certain most preferred embodiments the pressure alone of the inlet natural gas stream or streams provides the driving energy for the method and no external additional energy is required to accomplish the method. In certain preferred embodiments a mist is formed of condensed hydrocarbon droplets of at least 0.1 micrometer or larger in a largest dimension and filter media is used which is capable of filtering out such droplets. In other embodiments filter media is selected, as desired, to remove droplets of these sizes (largest dimension) in micrometers, or larger: 0.2, 0.3, 0.4, 0.5,, 0.6, 0.7, 0.8, or 0.9. A valve 21 on line G provides back-pressure on line G.

Figure 3:
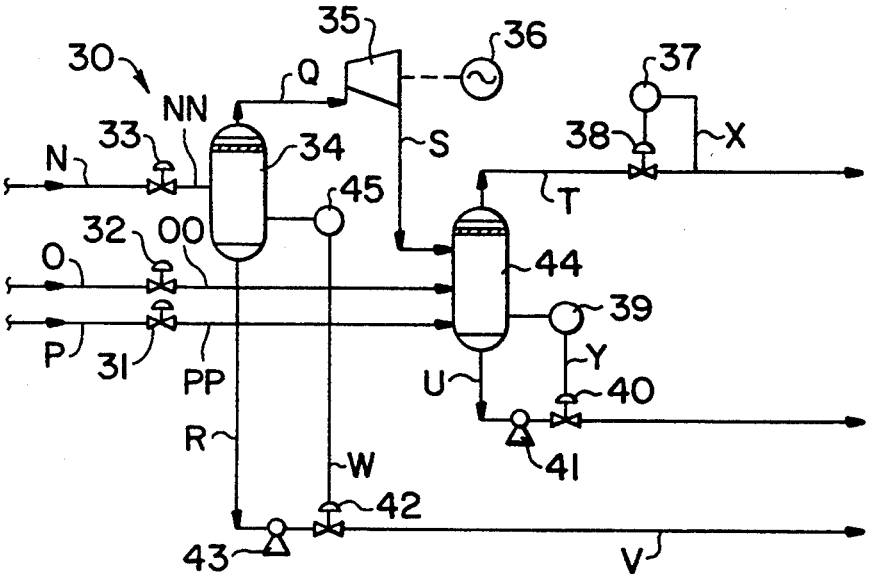
FIG. 3 is a schematic view of a method according to the present invention.

A method 30 according to this invention as shown in FIG. 3 is useful with a variety of natural gas input streams which are at different pressures, with one or more of them at a relatively high pressure. This method uses the high pressure gas to generate energy useful in this or other methods or apparatuses. Input gas in a flow line N at a relatively high pressure is introduced to a filter separator 34 which separates the gas, which is still at the line pressure, and which then flows to some type of energy-using or energy-recovery device, e.g. a turbo-expander 35 which produces energy to run an alternator 36. The gas then flows in line S to a filter separator 44 into which other gas in flow lines O and P also flows. Valves 31, 32, 33 control flow in the lines P, O, and N respectively. Gas flows in a line NN to the filter separator 34 from the valve 33. Gas flows in a line OO to the filter separator 44 from the valve 32. Gas flows in a line PP to the filter separator 44 from the valve 31. Preferably the gas in line S is at a pressure near the pressure of the gas in lines O and P. The filter separator 44 produces a condensate (liquid) stream U and a gas stream T. The filter separator 34 also produces a liquid stream R. The various stream compositions are as shown in Table 3 and the streams have these characteristics in one embodiment:

| | Temperature (degrees F.) | Pressure (psig) | Volume (MMSCFD) |
|---|---|---|---|
| N | 61.8 | 743.4 | 75.5 |
| O | 69.1 | 328.1 | 28.8 |
| P | 61.3 | 319.7 | 170.2 |
| R | 61.8 | 743.4 | |
| T | 39.1 | 300 | |
| U | 39.1 | 300 | |

The pressure in line T is controlled with a pressure control valve 38 with a sensor 37 that senses pressure in the line via a sensing line X. The valve 38 and sensor 37 are preferably remotely operated. The liquid level in the filter separator 34 is maintained by a level control 45 and a signal transmitting line W. Flow in the line R is controlled by a valve 42. The valve 42 controls liquid level in the separator 34. Condensate in the line can flow through the line V by pressure differential.

The liquid level in the filter separator 44 is maintained by a level control 39 and a signal transmitting line Y. Flow in the line U is controlled by a valve 40. The valve 40 controls liquid level in the separator 44. A pump 41 pumps condensate in the line U out of the system.

Figure 4:
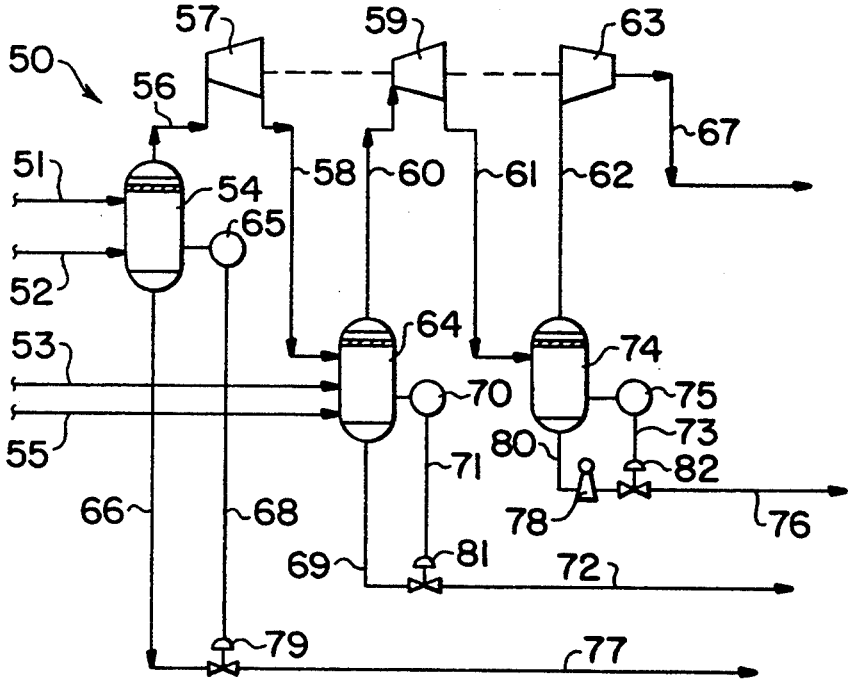
FIG. 4 is a schematic view of a method according to the present invention.

A process 50 shown in FIG. 4 is also useful with a plurality of typical pipeline gas streams when one or more of the streams is at a relatively high pressure compared to other streams and it is desired to recover energy from one or more of the high pressure streams. Natural gas flows in lines 51 and 52 to a filter separator 54 which produces a stream of condensates from the natural gas which flows out in line 66, through a valve 79, and exits the system in a line 77. The filter separator 54 also produces a high pressure gas stream which flows in line 56 to a turboexpander 57. In the turboexpander 57 energy is recovered and the line pressure is reduced so that gas at a reduced pressure flows in line 58 to a filter separator 64 for further filtration. Natural gas in lines 53 and 55 also flows to the filter separator 64. The filter separator 64 produces a liquid stream which flows out in line 69, through a valve 81 and exits the system in a line 72. The filter separator 64 also produces a gas stream which flows in line 60 to a turboexpander 59. Gas at reduced pressure flows from the turboexpander 59 in line 61 to another filter separator 74. The filter separator 74 produces a liquids stream 80 which is pumped by a pump 78 away from the system for further downstream processing if desired. The filter separator 74 also produces a gas stream 62 which flows to a compressor 63 wherein it is compressed to a desired exit pressure and flows out in line 67.

A level control 65 in a signal transmitting line 68 maintains a liquid level in the filter separator 54. A level control 70 in a signal transmitting line 71 maintains a liquid level in the filter separator 64. A level control 75 in a signal transmitting line 73 maintains a liquid level in the filter separator 74. The valve 79 controls flow in the line 66; the valve 81 controls flow in the line 69; and a valve 82 controls flow in the line 80. A pump 78 pumps condensate in line 80 from the system. Liquid streams 72, 76, and 77 flow downstream, e.g. for further processing. In another aspect the lines 66, 69, and 80 may be combined into one exit stream.

In one embodiment the streams of a method 50 of the compositions as shown in Table 4 have these characteristics:

| | Temperature (degrees F.) | Pressure (psig) | Volume (MMSCFD) |
|---|---|---|---|
| 51 | 61.8 | 743.4 | 75 |
| 52 | 62.7 | 615.2 | 100 |
| 53 | 69.1 | 328.1 | 30 |
| 55 | 61.3 | 318.7 | 175 |
| 67 | 191.0 | 300 | |
| 66 | 63.9 | 615.2 | |

Figure 5:
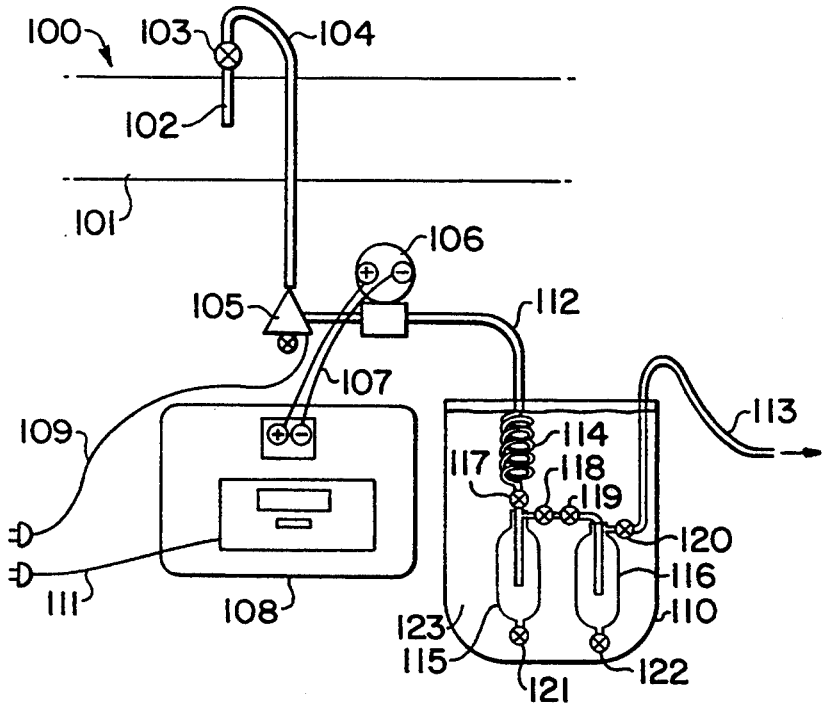
FIG. 5 is a schematic view of gas collection apparatus according to the present invention.
Figure 6:
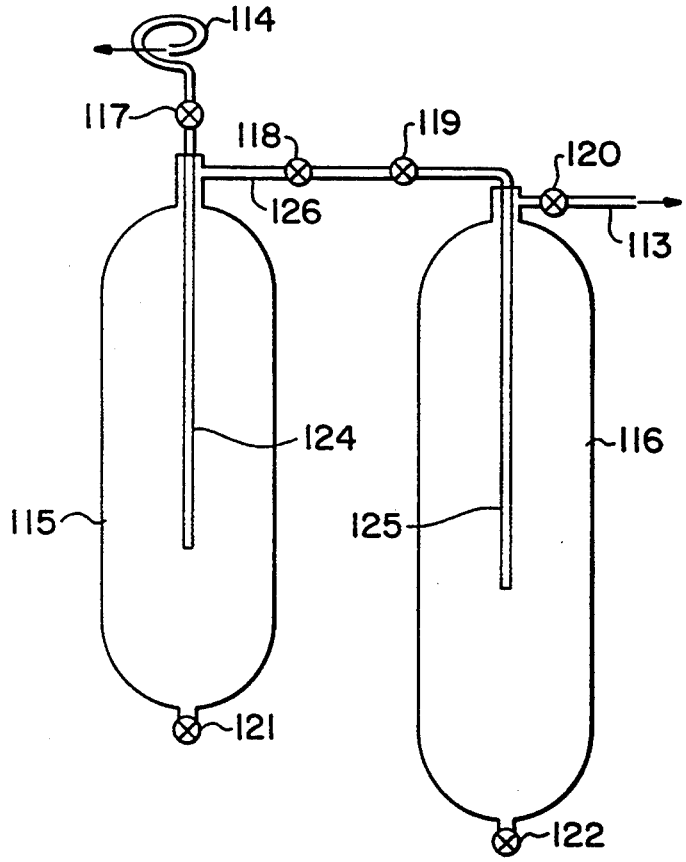
FIG. 6 is an enlarged view of part of the apparatus of FIG. 5.

FIG. 5 illustrates gas collection apparatus 100 according to the present invention. The apparatus 100 includes a probe 102 within a natural gas pipeline 101. Collected gas flows from the probe 102 through a conduit 104 to a heating regulator valve 105. A valve 103 controls flow in the conduit 104 (preferably stainless steel tubing able to withstand pipeline pressures, e.g. 600 to 1000 psig. The heating regulator valve 105 reduces the gas pressure to about 15 psig and heats the collected gas so that it contains little or no condensates (e.g. to just above the dew point, e.g. to 110 degrees F.

or more, up to 300 degrees F.). A commercially available transmitter/sensor 106 sends a signal via lines 107 to a mass flow recorder 108 which measures and records the flow rate and volume of flow through the line 104 to a line 112. Electrical power is provided to the valve 105 through power line 109 and to the recorder 108 through power line 111. The sample gas in the line 112 flows to a collection device with a container 110 full of ice or dry ice 123 (temperature preferably at about −110 degrees F.). The sample gas flows to a condensing coil 114 (preferably 316 stainless steel, six to twelve feet long) and then condensates produced in the coil are collected in collection cylinders 115 and 116. The gas sample exits the system (minus removed condensate) in a line 113. A valve 117 controls flow to the first collection cylinder 115. Valves 118 and 119 control flow to the second collection cylinder 116 and make it possible to shut off and close the two collection cylinders and disconnect each of them for weighing. A valve 120 controls flow in the exit line 113. A valve 121 controls liquid flow from the collection cylinder 115. A valve 122 controls liquid flow from the collection cylinder 116. Dip tubes 124 and 125 extend into each collection cylinder, preferably up to one-half to three-quarters of the length of the cylinders. The dip tubes provide a mist flow path and insure complete condensation drop out and, preferably, run in through a bored out stainless steel tee which allows liquid to drop down into the cylinders while allowing gas to escape past the dip tubes and out through the line 113.

By employing two collection cylinders the great majority, and most preferably 100% of condensates, are removed from the sample gas. In one embodiment about 99.9% of the condensate is collected in the first cylinder and about 0.1% is collected in the second cylinder. Although the total amount collected in the second cylinder may be relatively small in volume, it may be critical for a correct and precise analysis of the gas flowing in the pipeline 101. This also impacts the determination of which filter media to use in the methods discussed above. In certain embodiments a sample is collected continuously for six hours or more, up to twenty four hours.

Figure 7:
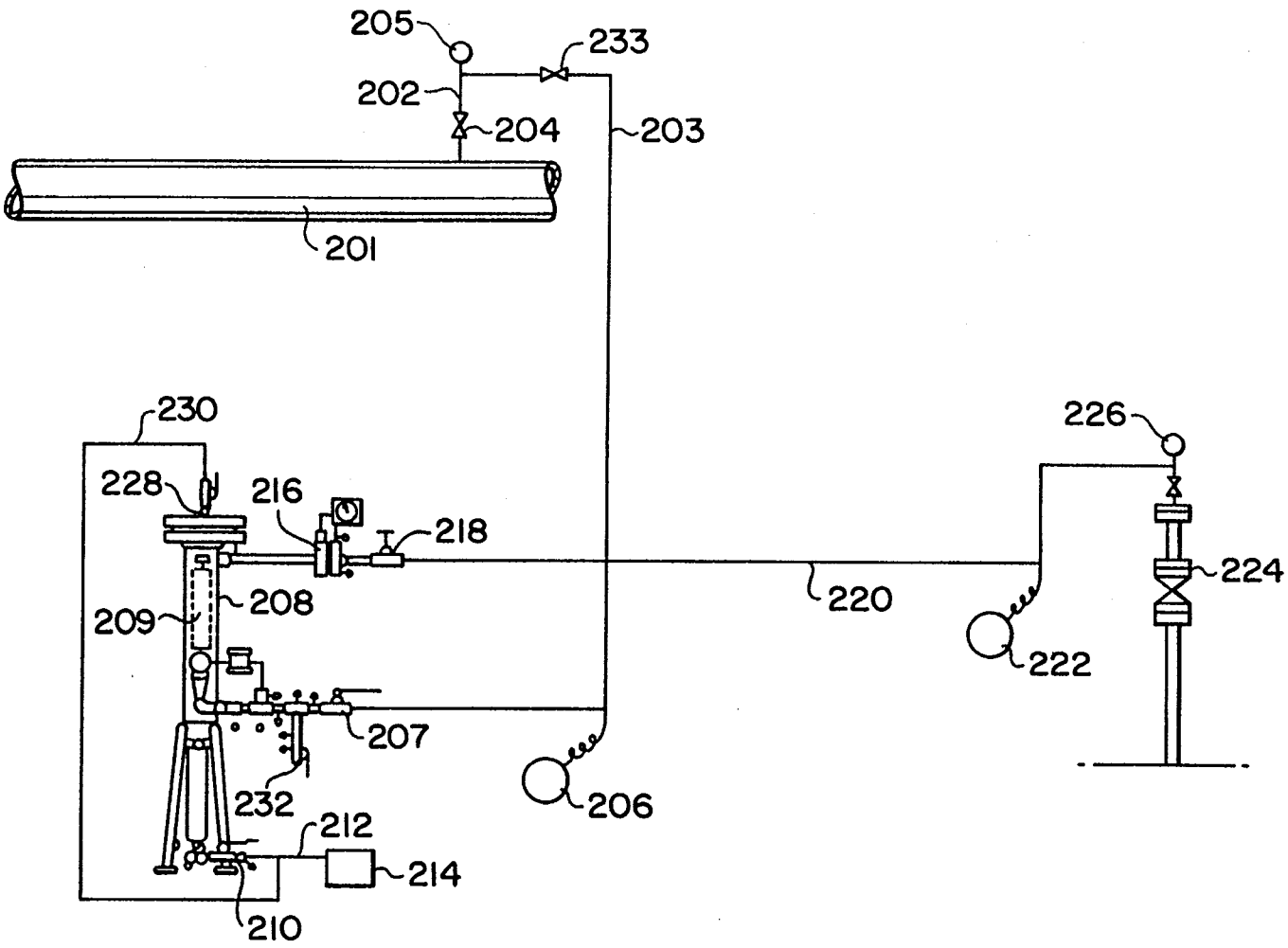
FIG. 7 is a schematic view of a filter media test system according to the present invention.

FIG. 7 illustrates a testing system 200 according to the present invention for testing a particular filter media and its filtration of a particular natural gas stream. A sample stream 202 in a line 203 is taken from a pipeline natural gas stream 201. The sample line 203 is, e.g., a one-inch stainless steel line. The valves 204 and 233 control flow in the line 203 and a gauge 205 indicates line pressure. Liquids in the stream 202 are sampled and collected in an inlet cold trap 206 for analysis. A sample of the stream 202 may be taken with a sampling apparatus 232. An inlet housing 208 and through a filter element 209 of microporous filter media. Filtered condensate (liquids) from the sample stream 202 flows to a drain 210 and to a drain outlet 212 for flow to a collection cold trap 214 for collection and subsequent analysis of liquids content and composition. A filtered gas stream flows through a flow meter 216, through an outlet valve 218 to a gas exit flow line 220. Liquids in the flow line 220 are sampled and collected in a cold trap 222 for analysis. The stream in the line 220 flows into additional downstream apparatus, and then to a downstream pipeline 224. A gauge 226 indicates line pressure in the line 220. Balancing of the pipeline pressure and exit pressure is accomplished by opening a vent valve 228 which controls flow in a tubing line 230 which intercommunicates with the drain outlet 212.

Table 5 indicates stream liquids composition for the system of FIG. 7 for an inlet stream 202 ("Inlet"), a filtered liquids stream as flows to the drain outlet 212 ("Filter"), and an outlet stream as flows through l=the line 220 ("Outlet") for an inlet gas stream with the composition shown in the column labeled "Pipeline". This test employed a 0.1 micrometer filter, i.e. filter media that removed all droplets of a largest dimension of 0.1 micrometer or larger.

In certain embodiments of liquid removal systems as previously described (FIGS. 1–6), valve output pressure is adjusted so that heavier hydrocarbons form a mist of removable droplets, e.g. $C_6$ and heavier hydrocarbons. As desired, valve output pressure (and hence temperature) may be adjusted to also remove relatively lighter hydrocarbons, e.g. $C_2$, $C_3$, $C_4$, etc. In this way the nature of a system exit stream may be adjusted to be relatively "dry" (most heavier hydrocarbons removed) or a filtered gas stream of relatively high Btu content (i.e., with a significant percentage of an inlet stream's heavier hydrocarbons remaining in the gas) may be produced. This is facilitated by compiling test results for a variety of inlet streams and a variety of filter media (as in FIG. 7). By adjusting a valve's output pressure and temperature, the dew point of heavier and then relatively lighter hydrocarbons may be selectively achieved so that droplets of desired hydrocarbons are formed as needed and as coordinated with a selected filter media. This also enables a system to overcome a retrograde condensation problem of large amounts of unwanted and often dangerous liquids forming and flowing in a system flow line.

Abbreviations used in the Tables are explained in Table 6.

"Components: Mole Frac" in the tables means mole fraction.

TABLE 1

| | STREAM ID | | | | | |
|---|---|---|---|---|---|---|
| | A | B | C | D | E | F |
| COMPONENTS: MOLE FRAC | | | | | | |
| HE | 0.0 | 0.0 | 0.0 | 0.0 | 0.0 | 0.0 |
| N2 | 2.9864-03 | 1.0214-02 | 7.1701-03 | 7.1701-03 | 7.1822-03 | 2.8313-04 |
| CH4 | 0.9550 | 0.9416 | 0.9473 | 0.9473 | 0.9487 | 0.1225 |
| CO2 | 4.5266-03 | 1.3739-02 | 9.8596-03 | 9.8596-03 | 9.8655-03 | 6.5462-03 |
| C2H6 | 1.9158-02 | 2.5836-02 | 2.3024-02 | 2.3024-02 | 2.3030-02 | 1.9619-02 |
| C3H8 | 6.1105-03 | 5.5734-03 | 5.7996-03 | 5.7996-03 | 5.7766-03 | 1.8800-02 |
| IC4H10 | 2.1769-03 | 6.6503-04 | 1.3017-03 | 1.3017-03 | 1.2852-03 | 1.0635-02 |
| NC4H10 | 1.3214-03 | 8.3857-04 | 1.0419-03 | 1.0419-03 | 1.0216-03 | 1.2525-02 |
| IC5H12 | 1.5681-03 | 3.7417-04 | 8.7697-04 | 8.7697-04 | 8.3135-04 | 2.6658-02 |
| NC5H12 | 1.1540-03 | 3.1123-04 | 6.6616-04 | 6.6616-04 | 6.1938-04 | 2.7108-02 |
| 22DMBUTA | 1.3512-04 | 6.7326-06 | 6.0802-05 | 6.0802-05 | 5.4435-05 | 3.6592-03 |
| CYCLOPEN | 2.1722-04 | 6.4740-06 | 9.5226-05 | 9.5226-05 | 8.5628-05 | 5.5194-03 |
| 2MPENTAN | 5.1561-04 | 2.3418-05 | 2.3070-04 | 2.3070-04 | 1.9514-04 | 2.0326-02 |

TABLE 1-continued

| | STREAM ID | | | | | |
|---|---|---|---|---|---|---|
| | A | B | C | D | E | F |
| C6H14 | 7.7924-04 | 2.6530-04 | 4.8174-04 | 4.8174-04 | 3.8190-04 | 5.6905-02 |
| MCYCLOPE | 5.6926-04 | 3.0874-05 | 2.5761-04 | 2.5761-04 | 2.0197-04 | 3.1699-02 |
| C7H16 | 6.8870-04 | 2.1703-04 | 4.1567-04 | 4.1567-04 | 2.2162-04 | 0.1100 |
| MCYCLOHE | 1.6387-04 | 9.5060-06 | 7.4515-05 | 7.4515-05 | 4.1477-05 | 1.8746-02 |
| C8H16 | 7.1778-05 | 1.0566-05 | 3.6344-05 | 3.6344-05 | 1.0051-05 | 1.4896-02 |
| C8H18 | 4.5172-04 | 1.2964-04 | 2.6528-04 | 2.6528-04 | 6.8803-05 | 0.1113 |
| BENZENE | 2.8481-04 | 1.9377-05 | 1.3116-04 | 1.3116-04 | 1.0013-04 | 1.7668-02 |
| CYCLOHEX | 8.0394-05 | 2.9979-06 | 3.5592-05 | 3.5592-05 | 2.6285-05 | 5.2957-03 |
| 2MHEXANE | 4.4467-04 | 2.7944-05 | 2.0344-04 | 2.0344-04 | 1.2744-04 | 4.3157-02 |
| TOLUENE | 3.7176-04 | 1.1499-05 | 1.6322-04 | 1.6322-04 | 7.5616-05 | 4.9670-02 |
| C9H18 | 6.2373-04 | 9.3922-06 | 2.6811-04 | 2.6811-04 | 3.1049-05 | 0.1342 |
| NC9H20 | 1.4540-04 | 1.9712-07 | 6.1346-05 | 6.1346-05 | 6.0327-06 | 3.1321-02 |
| C10S | 2.5766-04 | 1.8025-07 | 1.0861-04 | 1.0861-04 | 4.5006-06 | 5.8947-02 |
| NC10H22 | 5.6542-05 | 0.0 | 2.3812-05 | 2.3812-05 | 8.0858-07 | 1.3024-02 |
| C11S | 7.3466-05 | 0.0 | 3.0939-05 | 3.0939-05 | 4.2590-07 | 1.7275-02 |
| NC11H24 | 2.1446-05 | 0.0 | 9.0315-06 | 9.0315-06 | 1.0301-07 | 5.0549-03 |
| C12S | 1.5932-05 | 0.0 | 6.7097-06 | 6.7097-06 | 3.0839-08 | 3.7812-03 |
| NC12H26 | 7.8716-06 | 0.0 | 3.3150-06 | 3.3150-06 | 1.2553-08 | 1.8697-03 |
| NC13H28 | 3.6363-06 | 0.0 | 1.5314-06 | 1.5314-06 | 1.9715-09 | 8.6587-04 |
| H2O | 0.0 | 0.0 | 0.0 | 0.0 | 0.0 | 0.0 |

TABLE 2

| | STREAM ID | | | | | | | |
|---|---|---|---|---|---|---|---|---|
| | H | G | I | J | Z | K | L | M |
| COMPONENTS: MOLE FRAC | | | | | | | | |
| HE | 0.0 | 0.0 | 0.0 | 0.0 | 0.0 | 0.0 | 0.0 | 0.0 |
| N2 | 1.0214-02 | 2.9861-03 | 7.1161-03 | 7.1161-03 | 7.1563-03 | 7.1161-03 | 7.1563-03 | 3.5041-04 |
| CH4 | 0.9416 | 0.9550 | 0.9473 | 0.9473 | 0.9519 | 0.9473 | 0.9519 | 0.1880 |
| CO2 | 1.3739-02 | 4.5267-03 | 9.7908-03 | 9.7908-03 | 9.7542-03 | 9.7908-03 | 9.7542-03 | 1.5959-02 |
| C2H6 | 2.5836-02 | 1.9158-02 | 2.2974-02 | 2.2974-02 | 2.2839-02 | 2.2974-02 | 2.2839-02 | 4.5646-02 |
| C3H8 | 5.5735-03 | 6.1105-03 | 5.8037-03 | 5.8037-03 | 5.4973-03 | 5.8037-03 | 5.4973-03 | 5.7389-02 |
| IC4H10 | 6.6497-04 | 2.1768-03 | 1.3130-03 | 1.3130-03 | 1.1074-03 | 1.3130-03 | 1.1074-03 | 3.5926-02 |
| NC4H10 | 8.3869-04 | 1.3215-03 | 1.0456-03 | 1.0456-03 | 7.9847-04 | 1.0456-03 | 7.9847-04 | 4.2664-02 |
| IC5H12 | 3.7424-04 | 1.5681-03 | 8.8594-04 | 8.8594-04 | 4.4029-04 | 8.8594-04 | 4.4029-04 | 7.5926-02 |
| NC5H12 | 3.1119-04 | 1.1541-03 | 6.7246-04 | 6.7246-04 | 2.6710-04 | 6.7246-04 | 2.6710-04 | 6.8927-02 |
| 22DMBUTA | 6.7984-06 | 1.3505-04 | 6.1769-05 | 6.1769-05 | 1.7961-05 | 6.1769-05 | 1.7961-05 | 7.4384-03 |
| CYCLOPEN | 6.3880-06 | 2.1720-04 | 9.6742-05 | 9.6742-05 | 2.8743-05 | 9.6742-05 | 2.8743-05 | 1.1547-02 |
| 2MPENTAN | 2.3395-05 | 5.1572-04 | 2.3441-04 | 2.3441-04 | 4.3666-05 | 2.3441-04 | 4.3666-05 | 3.2352-02 |
| C6H14 | 2.6534-04 | 7.7935-04 | 4.8564-04 | 4.8564-04 | 6.1311-05 | 4.8564-04 | 6.1311-05 | 7.1936-02 |
| MCYCLOPE | 3.0916-05 | 5.6933-04 | 2.6168-04 | 2.6168-04 | 3.2509-05 | 2.6168-04 | 3.2509-05 | 3.8850-02 |
| BENZENE | 1.9412-05 | 2.8481-04 | 1.3316-04 | 1.3316-04 | 1.4446-05 | 1.3316-04 | 1.4446-05 | 2.0123-02 |
| CYCLOHEX | 3.0711-06 | 8.0444-05 | 3.6234-05 | 3.6234-05 | 3.4935-06 | 3.6234-05 | 3.4935-06 | 5.5491-03 |
| 2MHEXANE | 2.8030-05 | 4.4475-04 | 2.0664-04 | 2.0664-04 | 1.0378-05 | 2.0664-04 | 1.0378-05 | 3.3253-02 |
| C7H16 | 2.1702-04 | 6.8871-04 | 4.1919-04 | 4.1919-04 | 1.3174-05 | 4.1919-04 | 1.3174-05 | 6.8785-02 |
| MCYCLOHE | 9.4767-06 | 1.6385-04 | 7.5642-05 | 7.5642-05 | 2.9302-06 | 7.5642-05 | 2.9302-06 | 1.2319-02 |
| TOLUENE | 1.1408-05 | 3.7175-04 | 1.6585-04 | 1.6585-04 | 3.8742-06 | 1.6585-04 | 3.8742-06 | 2.7440-02 |
| C8H16 | 1.0595-05 | 7.1840-05 | 3.6845-05 | 3.6845-05 | 2.9414-07 | 3.6845-05 | 2.9414-07 | 6.1914-03 |
| C8H18 | 1.2958-04 | 4.5169-04 | 2.6764-04 | 2.6764-04 | 1.9907-06 | 2.6764-04 | 1.9907-06 | 4.4998-02 |
| C9H18 | 9.4182-06 | 6.2379-04 | 2.7274-04 | 2.7274-04 | 6.0414-07 | 2.7274-04 | 6.0414-07 | 4.6096-02 |
| NC9H20 | 1.3435-07 | 1.4544-04 | 6.2411-05 | 6.2411-05 | 1.0969-07 | 6.2411-05 | 1.0969-07 | 1.0553-02 |
| C10S | 1.2285-07 | 2.5763-04 | 1.1049-04 | 1.1049-04 | 6.2564-08 | 1.1049-04 | 6.2564-08 | 1.8705-02 |
| NC10H22 | 0.0 | 5.6535-05 | 2.4231-05 | 2.4231-05 | 1.0492-08 | 2.4231-05 | 1.0492-08 | 4.1026-03 |
| C11S | 0.0 | 7.3508-05 | 3.1506-05 | 3.1506-05 | 4.3902-09 | 3.1506-05 | 4.3902-09 | 5.3358-03 |
| NC11H24 | 0.0 | 2.1433-05 | 9.1863-06 | 9.1863-06 | 1.0006-09 | 9.1863-06 | 1.0006-09 | 1.5558-03 |
| C12S | 0.0 | 1.5964-05 | 6.8424-06 | 6.8424-06 | 2.4152-10 | 6.8424-06 | 2.4152-10 | 1.1589-03 |
| NC12H26 | 0.0 | 7.8878-06 | 3.3807-06 | 3.3807-06 | 9.2804-11 | 3.3807-06 | 9.2804-11 | 5.7262-04 |
| NC13H28 | 0.0 | 3.5965-06 | 1.5415-06 | 1.5415-06 | 1.1064-11 | 1.5415-06 | 1.1064-11 | 2.6110-04 |
| H2O | 0.0 | 0.0 | 0.0 | 0.0 | 0.0 | 0.0 | 0.0 | 0.0 |

TABLE 3

| | STREAM ID | | | | | | | | | | |
|---|---|---|---|---|---|---|---|---|---|---|---|
| | N | O | P | NN | Q | V | S | OO | PP | T | U |
| COMPONENTS: MOLE FRAC | | | | | | | | | | | |
| HE | 0.0 | 0.0 | 0.0 | 0.0 | 0.0 | 0.0 | 0.0 | 0.0 | 0.0 | 0.0 | 0.0 |
| N2 | 2.9861-03 | 2.7871-03 | 5.6089-03 | 2.9861-03 | 2.9996-03 | 2.7969-04 | 2.9996-03 | 2.7871-03 | 5.6089-03 | 4.6058-03 | 1.8022-04 |
| CH4 | 0.9550 | 0.9310 | 0.9501 | 0.9550 | 0.9585 | 0.2458 | 0.9585 | 0.9310 | 0.9501 | 0.9520 | 0.1215 |
| CO2 | 4.5267-03 | 6.3481-03 | 9.5104-03 | 4.5267-03 | 4.5266-03 | 4.5445-03 | 4.5266-03 | 6.3481-03 | 9.5104-03 | 7.8173-03 | 5.0766-03 |
| C2H6 | 1.9158-02 | 3.0424-02 | 2.1885-02 | 1.9158-02 | 1.9136-02 | 2.3505-02 | 1.9136-02 | 3.0424-02 | 2.1885-02 | 2.2036-02 | 1.8359-02 |
| C3H8 | 6.1105-03 | 1.0130-02 | 5.1479-03 | 6.1105-03 | 6.0305-03 | 2.2119-02 | 6.0305-03 | 1.0130-02 | 5.1479-03 | 5.8888-03 | 1.8579-02 |
| IC4H10 | 2.1768-03 | 5.0649-03 | 1.5496-03 | 2.1768-03 | 2.1058-03 | 1.6397-02 | 2.1058-03 | 5.0649-03 | 1.5496-03 | 2.0439-03 | 1.6288-02 |
| NC4H10 | 1.3215-03 | 3.2431-03 | 1.0849-03 | 1.3215-03 | 1.2600-03 | 1.3636-02 | 1.2600-03 | 3.2431-03 | 1.0849-03 | 1.3319-03 | 1.5693-02 |
| IC5H12 | 1.5681-03 | 2.9340-03 | 9.3685-04 | 1.5681-03 | 1.4101-03 | 3.3194-02 | 1.4101-03 | 2.9340-03 | 9.3685-04 | 1.2073-03 | 3.6957-02 |
| NC5H12 | 1.1541-03 | 2.1835-03 | 7.1679-04 | 1.1541-03 | 1.0072-03 | 3.0547-02 | 1.0072-03 | 2.1835-03 | 7.1679-04 | 8.8122-04 | 3.6735-02 |
| 22DMBUTA | 1.3505-04 | 2.3158-04 | 9.0611-05 | 1.3505-04 | 1.1181-04 | 4.7864-03 | 1.1181-04 | 2.3158-04 | 9.0611-05 | 9.9185-05 | 6.3337-03 |

TABLE 3-continued

| | STREAM ID | | | | | | | | | | |
|---|---|---|---|---|---|---|---|---|---|---|---|
| | N | O | P | NN | Q | V | S | OO | PP | T | U |
| CYCLOPEN | 2.1720-04 | 2.3949-04 | 9.3563-05 | 2.1720-04 | 1.7875-04 | 7.9108-03 | 1.7875-04 | 2.3949-04 | 9.3563-05 | 1.1840-04 | 7.2821-03 |
| 2MPENTAN | 5.1572-04 | 6.4130-04 | 2.4290-04 | 5.1572-04 | 3.9757-04 | 2.4155-02 | 3.9757-04 | 6.4130-04 | 2.4290-04 | 2.7525-04 | 2.7135-02 |
| C6H14 | 7.7935-04 | 1.1305.03 | 5.9450-04 | 7.7935-04 | 5.5657-04 | 4.5354-02 | 5.5657-04 | 1.1305-03 | 5.9450-04 | 5.0430-04 | 7.0942-02 |
| MCYCLOPE | 5.6933-04 | 6.8327-04 | 2.8575-04 | 5.6933-04 | 3.9463-04 | 3.5525-02 | 3.9463-04 | 6.8327-0.4 | 2.8575-04 | 2.7800-04 | 4.1348-02 |
| BENZENE | 2.8481-04 | 2.6566-04 | 1.8796-04 | 2.8481-04 | 1.8865-04 | 1.9525-02 | 1.8865-04 | 2.6566-04 | 1.8796-04 | 1.4852-04 | 2.4883-02 |
| CYCLOHEX | 8.0444-05 | 7.3821-05 | 4.0733-05 | 8.0444-05 | 5.1715-05 | 5.8287-03 | 5.1715-05 | 7.3821-05 | 4.0733-05 | 3.4543-05 | 6.5948-03 |
| 2MHEXANE | 4.4475-04 | 5.9245-04 | 3.1793-04 | 4.4475.04 | 2.5059-04 | 3.9292-02 | 2.5059-04 | 5.9245-04 | 3.1793-04 | 2.0366-04 | 6.4707-02 |
| C7H16 | 6.8871-04 | 7.6548-04 | 5.4152-04 | 6.8871-04 | 3.3382-04 | 7.1697-02 | 3.3382-04 | 7.6548-04 | 5.4152-04 | 2.6796-04 | 0.1245 |
| MCYCLOHE | 1.6385-04 | 1.2122-04 | 7.0005-05 | 1.6385-04 | 7.9551-05 | 1.7031-02 | 7.9551-05 | 1.2122-04 | 7.0005-05 | 4.2846-05 | 1.8236-02 |
| TOLUENE | 3.7175-04 | 2.4972-04 | 1.3905-04 | 3.7175-04 | 1.4961-04 | 4.4817-02 | 1.4961-04 | 2.4972-04 | 1.3905-04 | 7.0056-05 | 4.3290-02 |
| C8H16 | 7.1840-05 | 7.7737-05 | 6.9586-05 | 7.1840-05 | 1.9874-05 | 1.0469-02 | 1.9874-05 | 7.7737-05 | 6.9586-05 | 1.5530-05 | 2.1380-02 |
| C8H18 | 4.5169-04 | 3.0768-04 | 2.9541-04 | 4.5169-04 | 1.2061-04 | 6.6697-02 | 1.2061-04 | 3.0768-04 | 2.9541-04 | 6.3837-05 | 9.5770-02 |
| C9H18 | 6.2379-04 | 2.7540-04 | 2.5743-04 | 6.2379-04 | 8.7566-05 | 0.1079 | 8.7566-05 | 2.7540-04 | 2.5743-04 | 2.4467-05 | 9.7460-02 |
| NC9H20 | 1.4544-04 | 6.1818-05 | 4.8733-05 | 1.4544-04 | 1.8206-05 | 2.5602-02 | 1.8206-05 | 6.1818-05 | 4.8733-05 | 4.0840-06 | 1.9490-02 |
| C10S | 2.5763-04 | 9.7083-05 | 1.0023-04 | 2.5763-04 | 1.6408-05 | 4.8522-02 | 1.6408-05 | 9.7083-05 | 1.0023-04 | 3.1911-06 | 3.8158-02 |
| NC10H22 | 5.6535-05 | 2.2340-05 | 1.9713-05 | 5.6535-05 | 3.1032-06 | 1.0747-02 | 3.1032-06 | 2.2340-05 | 1.9713-05 | 5.2587-07 | 7.7163-03 |
| C11S | 7.3508-05 | 2.4815-05 | 2.6370-05 | 7.3508-05 | 1.9714-06 | 1.4387-02 | 1.9714-06 | 2.4815-05 | 2.6370-05 | 2.7134-07 | 9.9605-03 |
| NC11H24 | 2.1433-05 | 5.0839-06 | 5.9814-06 | 2.1433-05 | 5.0099-07 | 4.2096-03 | 5.0099-07 | 5.0839-06 | 5.9814-06 | 5.0618-08 | 2.2429-03 |
| C12S | 1.5964-05 | 1.9314-06 | 5.5546-06 | 1.5964-05 | 1.8119-07 | 3.1740-03 | 1.8119-07 | 1.9314-06 | 5.5546-06 | 1.7335-08 | 1.9062-03 |
| MC12H26 | 7.8878-06 | 1.4844-06 | 1.8296-06 | 7.8878-06 | 7.7132-08 | 1.5707-03 | 7.7132-08 | 1.4844-06 | 1.8296-06 | 5.0766-09 | 6.7681-04 |
| NC13H28 | 3.5965-06 | 3.9185-07 | 1.6904-06 | 3.5965-06 | 1.5041-08 | 7.2019-04 | 1.5041-08 | 3.9185-07 | 1.6904-06 | 1.4520-09 | 5.6575-04 |
| H2O | 0.0 | 0.0 | 0.0 | 0.0 | 0.0 | 0.0 | 0.0 | 0.0 | 0.0 | 0.0 | 0.0 |

TABLE 4

| | STREAM ID | | | | | | | | | | | | |
|---|---|---|---|---|---|---|---|---|---|---|---|---|---|
| | 52 | 51 | 55 | 53 | 56 | 66 | 58 | 60 | 69 | 61 | 62 | 80 | 67 |
| COMPONENTS: MOLE FRAC | | | | | | | | | | | | | |
| HE | 0.0 | 0.0 | 0.0 | 0.0 | 0.0 | 0.0 | 0.0 | 0.0 | 0.0 | 0.0 | 0.0 | 0.0 | 0.0 |
| N2 | 2.7871-03 | 2.9861-03 | 1.0214-02 | 5.6089-03 | 2.9416-03 | 2.2693-04 | 2.9416-03 | 7.2881-03 | 2.8317-04 | 7.2881-03 | 7.3095-03 | 8.0908-05 | 7.3095-03 |
| CH4 | 0.9310 | 0.9550 | 0.9416 | 0.9501 | 0.9515 | 0.2070 | 0.9515 | 0.9475 | 0.1148 | 0.9475 | 0.9502 | 5.4482-02 | 0.9502 |
| CO2 | 6.3481-03 | 4.5267-03 | 1.3739-02 | 9.5104-03 | 5.0499-03 | 4.4190-03 | 5.0499-03 | 1.1051-02 | 6.2378-03 | 1.1051-02 | 1.1059-02 | 8.6249-03 | 1.1059-02 |
| C2H6 | 3.0424-02 | 1.9158-02 | 2.5836-02 | 2.1885-02 | 2.2367-02 | 2.4368-02 | 2.2367-02 | 2.3326-02 | 1.7100.02 | 2.3326-02 | 2.3329-02 | 2.2394-02 | 2.3329-02 |
| C3H8 | 1.0130-02 | 6.1105-03 | 5.5735-03 | 5.1479-03 | 7.1814-03 | 2.4214-02 | 7.1814-03 | 5.2971-03 | 1.3946-02 | 5.2971-03 | 5.2001-03 | 3.7918-02 | 5.2001-01 |
| IC4H10 | 5.0649-03 | 2.1768-03 | 6.6497-04 | 1.5496-03 | 2.9174-03 | 2.1500-02 | 2.9174-03 | 1.2236-03 | 7.8862-03 | 1.2236-03 | 1.1287-03 | 3.3117-02 | 1,1287.03 |
| NC4H10 | 3.2431-03 | 1.3215-03 | 8.3869-04 | 1.0849-03 | 1.7945-03 | 1.8505-02 | 1.7945-03 | 9.9008-04 | 9.2445-03 | 9.9008-04 | 8.5558-04 | 4.6194-02 | 8.5558-04 |
| IC5H12 | 2.9340-03 | 1.5681-03 | 3.7424-04 | 9.3685-04 | 1.7795.03 | 4.1101-02 | 1.7795-03 | 7.2189-04 | 1.6937-02 | 7.2189-04 | 4.3173-04 | 9.8241-02 | 4.3173-04 |
| NC5H12 | 2.1835-03 | 1.1541-03 | 3.1119-04 | 7.1679-04 | 1.2797-03 | 3.8333-02 | 1.2797-03 | 5.5843-04 | 1.7558-02 | 5.5843-04 | 2.6438-04 | 9.9386-02 | 2.6438-04 |
| 22DMBUTA | 2.3158-04 | 1.3505-04 | 6.7984-06 | 9.0611-05 | 1.3651.04 | 5.8790-03 | 1.3651-04 | 5.8380-05 | 2.7995-03 | 5.8380-05 | 1.9736-05 | 1.3046-02 | 1.9736-05 |
| CYCLOPEN | 2.3949-04 | 2.1720-04 | 6.3880-06 | 9.3563-05 | 1.8734-04 | 8.1509-03 | 1.8734-04 | 6.0157-05 | 2.7271-03 | 6.0157-05 | 2.1553-05 | 1.3034-02 | 2.1553-05 |
| 2MPENTAN | 6.4130-04 | 5.1572-04 | 2.3395-05 | 2.4290-04 | 4.3220-04 | 2.6682-02 | 4.3220-04 | 1.5597-04 | 1.1274-02 | 1.5597-04 | 3.0658-05 | 4.2272-02 | 3.0658-05 |
| C6H14 | 1.1305-03 | 7.7935-04 | 2.6534-04 | 5.9450-04 | 6.3979-04 | 5.3373-02 | 6.3979-04 | 4.4621-04 | 4.5199-02 | 4.4621-04 | 5.4249-05 | 0.1321 | 5.4249-05 |
| MCYCLOPE | 6.8327-04 | 5.6933-04 | 3.0916-05 | 2.8575-04 | 4.2688-04 | 3.8901-02 | 4.2688.04 | 1.8089-04 | 1.9249-02 | 1.8089.04 | 2.2872-05 | 5.3290-02 | 2.2872-05 |
| BENZENE | 2.6566-04 | 2.8481-04 | 1.9412-05 | 1.8796-04 | 1.9042-04 | 1.9739-02 | 1.9042-04 | 1.1787.04 | 1.3893-02 | 1.1787-04 | 1.3028-05 | 3.5352-02 | 1.3028-05 |
| CYCLOHEX | 7.3821-05 | 8.0444-05 | 3.0711-06 | 4.0733-05 | 5.1822-05 | 5.9284-03 | 5.1822-05 | 2.4902-05 | 3.3671-03 | 2.4902-05 | 2.3640-06 | 7.5996-03 | 2.3640-06 |
| 2MHEXANE | 5.9245-04 | 4.4475-04 | 2.8830-05 | 3.1793-04 | 2.7892-04 | 4.6012-02 | 2.7892.04 | 1.8615-04 | 4.1445-02 | 1.8615-04 | 7.1456-06 | 6.0346-02 | 7.1456-06 |
| C7H16 | 7.6548-04 | 6.8871-04 | 2.1702-04 | 5.4152-04 | 3.4978-04 | 7.9683.02 | 3.4978-04 | 3.5188-04 | 0.1124 | 3.5188-04 | 7.5221-06 | 0.1160 | 7.5221-06 |
| MCYCLOHE | 1.2122-04 | 1.6385-04 | 9.4767-06 | 7.0005-05 | 7.5347-05 | 1.6855-02 | 7.5347-05 | 4.0415-05 | 1.1904-02 | 4.0415-05 | 1.2361-06 | 1.3208-02 | 1.2361-06 |
| TOLUENE | 2.4972-04 | 3.7175-04 | 1.1408-05 | 1.3905-04 | 1.3964-04 | 4.3502-02 | 1.3964-04 | 7.3322-05 | 3.0303-02 | 7.3322-05 | 1.2059-06 | 2.4311-02 | 1.2059-06 |
| C8H16 | 7.7737-05 | 7.1840-05 | 1.0595-05 | 6.9586-05 | 2.0439-05 | 1.1691-02 | 2.0439-05 | 3.0607-05 | 2.7469-02 | 3.0607-05 | 1.1895-07 | 1.0277.02 | 1.1895-07 |
| C8H18 | 3.0768-04 | 4.5169-04 | 1.2958-04 | 2.9541-04 | 1.0915-04 | 6.6370-02 | 1.0915-04 | 1.4424-04 | 0.1423 | 1.4424-04 | 5.1042-07 | 4.8451-02 | 5.1042.07 |
| C9H18 | 2.7540-04 | 6.2379-04 | 9.4182-06 | 2.5743-04 | 7.1592-05 | 9.9588-02 | 7.1592-05 | 6.4103-05 | 0.1615 | 6.4103-05 | 5.1031-08 | 2.1591-02 | 5.1031-08 |
| NC9H20 | 6.1818-05 | 1.4544-04 | 1.3435-07 | 4.8733-05 | 1.4672-05 | 2.3511-02 | 1.4672-05 | 1.0639-05 | 3.1978-02 | 1.0639-05 | 6.2637-09 | 3.5842-03 | 6.2637-09 |
| C10S | 9.7083-05 | 2.5763-04 | 1.2285-07 | 1.0023-04 | 1.2625-05 | 4.3792-02 | 1.2625-05 | 1.1281-05 | 8.2267-02 | 1.1281-05 | 1.6410-09 | 3.8023-03 | 1.6410-09 |
| NC10H22 | 2.2340-05 | 5.6535-05 | 0.0 | 1.9713-05 | 2.3845-06 | 9.7594-03 | 2.3845-06 | 1.8812-06 | 1.6695-02 | 1.8812-06 | 1.9407-10 | 6.3406-04 | 1.9407-10 |
| C11S | 2.4815-05 | 7.3508-05 | 0.0 | 2.6370-05 | 1.4422-06 | 1.2786-02 | 1.4422-06 | 1.1404-06 | 2.4485-02 | 1.1404-06 | 2.9113-11 | 3.8440-04 | 2.9113-11 |
| NC11H24 | 5.0839-06 | 2.1433-05 | 0.0 | 5.9814-06 | 3.5055-07 | 3.6084-03 | 3.5055-07 | 2.1813-07 | 5.6173-03 | 2.1813-07 | 4.0472-12 | 7.3526-05 | 4.0472-12 |
| C12S | 1.9314-06 | 1.5964-05 | 0.0 | 5.5546-06 | 1.1787-07 | 2.6025-03 | 1.1787-07 | 8.7253-08 | 5.3969-03 | 8.7253.08 | 4.0221-13 | 2.9412-05 | 4.0221-13 |
| NC12H26 | 1.4844-06 | 7.8878-06 | 0.0 | 1.8296-06 | 5.1120-08 | 1.3207-03 | 5.1120-08 | 2.3996-08 | 1.7851-03 | 2.3996-08 | 8.0333-14 | 8.0886-06 | 8.0333-14 |
| NC13H28 | 3.9185-07 | 3.5965-06 | 0.0 | 1.6904-06 | 9.3235-09 | 5.8735-04 | 9.3235-09 | 7.9836-09 | 1.6715-03 | 7.9936-09 | 5.0188-15 | 2.6912-06 | 5.0188-15 |
| H2O | 0.0 | 0.0 | 0.0 | 0.0 | 0.0 | 0.0 | 0.0 | 0.0 | 0.0 | 0.0 | 0.0 | 0.0 | 0.0 |

TABLE 5

| COMPONENT, WT % | IN-LET | FILTER | OUT-LET | PIPE-LINE |
|---|---|---|---|---|
| $N_2$ | | | | 0.474 |
| $CH_4$ | | | | 91.040 |
| $CO_2$ | | | | 1.171 |
| C2 | <0.1 | <0.1 | <0.1 | 3.303 |
| C3 | 0.7 | 0.4 | 0.5 | 1.330 |
| ISOBUTANE | 3.4 | 2.1 | 3.8 | 0.679 |
| NORMAL BUTANE | 5.1 | 3.6 | 6.2 | 0.360 |
| ISOPENTANE | 13.9 | 11.4 | 15.1 | 0.370 |
| NORMAL PENTANE | 10.8 | 8.9 | 11.1 | 0.231 |
| 2,2 DIMETHYLBUTANE | 2.0 | 1.7 | 2.0 | 0.007 |
| 2,3 DIMETHYLBUTANE+ | 0.4 | 0.4 | | 0.002 |
| CYCLOPENTANE | 2.1 | 1.9 | 2.4 | 0.011 |
| 2 METHYLPENTANE | 6.5 | 6.1 | 6.4 | 0.029 |
| 3 METHYLPENTANE + | 3.2 | 3.0 | 3.0 | 0.014 |
| NORMAL HEXANE | 6.6 | 6.5 | 6.3 | 0.335 |
| METHYLCYCLO-PENTANE+ | | | | |
| BENZENE + | 3.0 | 3.2 | 2.8 | 0.013 |
| CYCLOHEXANE | 0.7 | 1.0 | 0.7 | 0.003 |
| 2 METHYLHEXANE + | 2.8 | 2.8 | 2.4 | 0.012 |
| 3 METHYLHEXANE | 3.4 | 3.5 | 3.5 | 0.015 |
| C7'S | 6.7 | 7.6 | 6.2 | 0.152 |
| NC-7 | 4.1 | 4.7 | 3.8 | 0.094 |
| METHYLCYCLO-HEXANE + | 4.0 | 4.5 | 3.7 | 0.017 |
| TOLUENE | 1.3 | 2.0 | 1.0 | 0.005 |
| C8'S | 9.9 | 8.3 | 6.9 | 0.041 |
| NORMAL OCTANE(NC-8) | 2.5 | 3.0 | 2.3 | 0.144 |
| C9'S | 5.1 | 6.4 | 4.6 | 0.022 |
| NC9 | 1.4 | 1.9 | 1.4 | 0.006 |
| C10'S | 1.8 | 2.7 | 1.9 | 0.009 |
| NC10 | 0.5 | 0.9 | 0.7 | 0.003 |
| C11'S | 0.4 | 0.6 | 0.5 | 0.003 |
| NC11 | 0.2 | 0.4 | 0.4 | 0.002 |
| C12'S | <0.1 | 0.9 | <0.1 | <0.001 |
| NC12 | <0.1 | 0.2 | <0.1 | <0.001 |
| C13'S | <0.1 | 0.1 | <0.1 | <0.001 |
| NC13 | <0.1 | <0.1 | <0.1 | <0.001 |

TABLE 6

| ABBREVIATION | FULL CHEMICAL NAMES |
|---|---|
| HE | HELIUM |
| N2 | NITROGEN |
| CH4 | METHANE |
| CO2 | CARBON DIOXIDE |
| C2H6 | ETHANE |
| C3H8 | PROPANE |
| IC4H10 | ISO-BUTANE |
| NC4H10 | NORMAL-BUTANE |
| IC5H12 | ISO-PENTANE |
| NC5H12 | NORMAL-PENTANE |
| 22DMBUTA | 2,2-DIMETHYL BUTANE |
| CYCLOPEN | CYCLOPENTANE |
| 2MPENTAN | 2-METHYL PENTANE |
| C6H14 | HEXANES |
| MCYCLOPE | METHYLCYCLOPENTANE |
| C7H16 | HEPTANES |
| MCYCLOHE | METHYLCYCLOHEXANE |
| C8H16 | OCTENES |
| C8H18 | OCTANES |
| BENZENE | BENZENE |
| CYCLOHEX | CYCLOHEXANE |
| 2MHEXANE | 2-METHYL HEXANE |
| TOLUENE | TOLUENE |
| C9H18 | NONENES |
| NC9H20 | NORMAL-NONANE |
| C10S | DECENES |
| NC10H22 | NORMAL DECANE |
| C11S | UNDECENES |
| NC11H24 | NORMAL UNDECANE |
| C12S | DODECENES |
| NC12H26 | NORMAL DODECANE |
| NC13H28 | NORMAL TRIDECANE |
| H2O | WATER |

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized.

What is claimed is:

1. A method for condensing hydrocarbons from a natural gas stream under pressure and removing them therefrom, the method comprising:

sampling the natural gas stream producing a sample thereof;

analyzing the sample to determine hydrocarbon content;

based on an analysis of the sample, choosing a selected microporous filter media for a filtering apparatus for removing selected hydrocarbons from the natural gas stream;

feeding an inlet natural gas stream containing condensable hydrocarbons to a throttling device;

reducing pressure of the inlet natural gas stream with the throttling device to condense condensable hydrocarbons in the inlet natural gas stream as a mist of droplets of at least 0.1 micrometer in a largest dimension;

flowing the inlet natural gas stream with the mist of droplets therein to a filtering apparatus at a temperature between −60° and +32 degrees F.;

filtering the droplets from the inlet natural gas stream with the selected microporous filter media in the filtering apparatus, the filtering producing a liquid stream with condensed hydrocarbons;

flowing the liquid stream into an exit flow line;

the filtering also producing a gas stream separate from the liquid stream; and flowing the gas stream away from the filtering apparatus.

2. The method of claim 1 wherein pressure of the natural gas stream alone provides driving energy for the method.

3. A method for removing condensable hydrocarbons from at least two inlet natural gas streams under pressure containing condensable hydrocarbons, the method comprising:

flowing a first stream of inlet natural gas containing condensable hydrocarbons under pressure to a first throttling device;

reducing pressure of the first stream with the first throttling device to condense condensable hydrocarbons as a first mist of droplets;

flowing the first stream with the first mist to a first filtering apparatus;

filtering the first mist from the first stream with microporous filter media in the first filtering apparatus, producing a first filtered gas stream and a first filtered liquids stream containing condensed hydrocarbons from the first stream;

flowing the first filtered gas stream to energy recovery apparatus, the first filtered gas stream reduced in pressure as it flows through the energy recovery apparatus and exiting it as a reduced pressure stream which contains hydrocarbons, the energy recovery apparatus recovering usable energy from the first filtered gas stream;

flowing the reduced pressure stream to a second filtering apparatus;

flowing a second stream of inlet natural gas containing condensable hydrocarbons to a second throttling device;

reducing pressure of the second stream with the second throttling device to condense condensable hydrocarbons as a second mist of droplets;

flowing the second stream with the second mist to the second filtering apparatus simultaneously with the reduced pressure stream; and filtering the second mist from the second stream and condensed hydrocarbons from the reduced pressure stream with microporous filter media in the second filtering apparatus, producing a second filtered gas stream and a second filtered liquids stream containing condensed hydrocarbons.

4. The method of claim 3 wherein the first stream, prior to flowing it to the first throttling device, is under a pressure 100 p.s.i.g. or more greater than the pressure of the second stream prior to flowing the second stream to the second throttling device.

5. The method of claim 4 wherein the first stream is under a pressure 400 p.s.i.g. or more greater than the pressure of the second stream.

6. The method of claim 3 wherein pressure of at least one of the natural gas streams provides driving energy for the method.

7. The method of claim 3 further comprising:

flowing the second filtered gas stream to second energy recovery apparatus to recover usable energy from the second filtered gas stream.

8. The method of claim 7 further comprising:

the second energy recovery apparatus producing a second reduced pressure stream, the second reduced pressure stream having hydrocarbons therein;

flowing the second reduced pressure stream to a third filtering apparatus;

filtering condensed hydrocarbons from the second reduced pressure stream with microporous filter media in the filtering apparatus, producing a liquid stream with filtered condensed hydrocarbons and a filtered gas stream.

9. The method of claim 8 wherein each stream fed to a filtering apparatus is at a temperature between −110° and +70 degrees. F.

10. The method of claim 9 wherein the temperature is between −60° and +32 degrees F.

11. The method of claim 8 wherein each throttling device produces a mist of droplets less than 0.7 micrometer and larger than 0.1 micrometer in a largest dimension in each stream exiting a throttling device.

12. The method of claim 11 wherein microporous filter media in each filtering apparatus filters the droplets from streams fed to the filtering apparatuses.

13. The method of claim 12 wherein hydrocarbons comprising $C_6$ and heavier are condensed by action of the throttling devices.

14. A collection apparatus for collecting liquids from a natural gas stream, the apparatus comprising:

probe apparatus for receiving and transmitting a sample stream of natural gas from a pipeline, the sample stream containing condensable hydrocarbons;

transmission apparatus for transmitting the sample stream to a collection device from the probe apparatus;

a collection device for collecting condensable hydrocarbons from the sample stream, the collection device comprising:

a container for holding ice or dry ice, a condensing coil communicating with the transmission apparatus so that condensable hydrocarbons in the sample stream are condensed in the condensing coil, a first collection cylinder into which flow hydrocarbons condensed from the sample stream, a second collection cylinder in fluid communication with the first collection cylinder, and into which second collection cylinder flow condensed hydrocarbons not collected in the first collection cylinder, and an exit flow line through which the sample stream exits the collection device.

15. The collection apparatus of claim 14 further comprising:

the transmission apparatus including a heating regulator valve for reducing pressure of the sample gas stream and for heating it to gasify condensates therein.

16. The collection apparatus of claim 14 wherein the pressure of the sample stream is reduced to about 15 p.s.i.g. or less and the temperature is raised to at least 110 degrees F.

17. The collection apparatus of claim 14 further comprising:

mass flow measuring apparatus for measuring volume of flow to the collection device.

18. The collection apparatus of claim 14 wherein about 99.9% of condensates in the sample stream are collected in the first collection cylinder and about 0.1% is collected in the second collection cylinder.

19. The collection apparatus of claim 14 further comprising:

gas analysis apparatus for analyzing condensed hydrocarbons from the collection cylinders.

20. A method for condensing hydrocarbons from a natural gas stream and removing them therefrom, the method comprising:

sampling an inlet natural gas stream containing condensable hydrocarbons producing a sample thereof;

analyzing the sample to determine hydrocarbon content;

based on an analysis of the sample choosing a selected microporous filter media for removing selected hydrocarbons from the inlet natural gas stream;

feeding the inlet natural gas stream containing condensable hydrocarbons under pressure to a throttling device;

reducing pressure of the inlet natural gas stream with the throttling device to condense condensable hydrocarbons in the inlet natural gas stream as a mist of droplets;

flowing the inlet natural gas stream with the mist of droplets therein to a filtering apparatus; and filtering the droplets from the inlet natural gas stream with microporous filter media in the filtering apparatus.

21. The method of claim 20 wherein the droplets are less than 0.7 micrometer in a largest dimension.

22. The method of claim 20 wherein temperature of the inlet natural gas stream fed to the filtering apparatus is between −110° and +70 degrees F.

23. The method of claim 22 wherein the temperature is between −60° and +32 degrees F.

24. The method of claim 20 wherein hydrocarbons comprising $C_6$ and heavier are condensed by action of the throttling device.

25. The method of claim 20 further comprising:

the filtering producing a liquid stream of condensed hydrocarbons; and flowing the liquid stream into an exit flow line.

26. The method of claim 25 further comprising:

the filtering producing a gas stream separate from the liquid stream; and flowing the gas stream away from the filtering apparatus.

27. The method of claim 26 further comprising:

flowing the gas stream in heat exchange relation with the inlet natural gas stream to cool the inlet natural gas stream.

28. The method of claim 20 wherein the inlet natural gas stream comprises two different initial natural gas streams combined to form the inlet natural gas stream.

29. The method of claim 20 wherein pressure of the inlet natural gas stream alone provides driving energy for the method.

* * * * *